US008388355B2

(12) United States Patent
Shedletsky

(10) Patent No.: US 8,388,355 B2
(45) Date of Patent: Mar. 5, 2013

(54) INTEGRATED NOISE REDUCTION CONNECTOR

(75) Inventor: Anna-Katrina Shedletsky, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/434,796

(22) Filed: Mar. 29, 2012

(65) Prior Publication Data

US 2012/0190239 A1 Jul. 26, 2012

Related U.S. Application Data

(63) Continuation of application No. 12/889,249, filed on Sep. 23, 2010, now Pat. No. 8,167,625.

(51) Int. Cl.
*H01R 12/00* (2006.01)

(52) U.S. Cl. ..... 439/55

(58) Field of Classification Search ..... 439/55, 439/620.09, 607.12, 608, 74, 660
See application file for complete search history.

(56) References Cited

U.S. PATENT DOCUMENTS

| | | | | |
|---|---|---|---|---|
| 3,553,672 | A | 1/1971 | Smith | |
| 4,326,665 | A | 4/1982 | Scott | |
| 4,329,665 | A | 5/1982 | Kawai et al. | |
| 4,444,550 | A | 4/1984 | Loubier | |
| 4,606,598 | A * | 8/1986 | Drzymkowski et al. | 439/607.12 |
| 4,929,196 | A * | 5/1990 | Ponn et al. | 439/620.09 |
| 5,015,204 | A | 5/1991 | Sakamoto et al. | |
| 5,242,318 | A | 9/1993 | Plass | |
| 5,528,205 | A | 6/1996 | Wong | |
| 5,575,073 | A | 11/1996 | von Wedemayer | |
| 5,735,696 | A | 4/1998 | Niitsu et al. | |
| 5,836,773 | A | 11/1998 | McHugh et al. | |
| 6,338,630 | B1 | 1/2002 | Dong | |
| 6,443,770 | B1 | 9/2002 | Lin | |
| 7,342,172 | B1 | 3/2008 | Wang et al. | |
| 2005/0032430 | A1 * | 2/2005 | Otsu et al. | 439/608 |
| 2006/0216960 | A1 * | 9/2006 | Chang | 439/74 |
| 2008/0268708 | A1 * | 10/2008 | Yamada et al. | 439/607 |
| 2010/0024211 | A1 * | 2/2010 | Levante et al. | 29/845 |
| 2010/0248548 | A1 * | 9/2010 | Burns et al. | 439/626 |

* cited by examiner

*Primary Examiner* — Jean F Duverne
(74) *Attorney, Agent, or Firm* — Kilpatrick Townsend & Stockton LLP

(57) ABSTRACT

An electrical connector comprising an insulative body, a plurality of pins carried by the body and a ferromagnetic element that rides on one of the plurality of the pins. The ferromagnetic element provides a low pass filter capability for signals transmitted over the one pin.

21 Claims, 5 Drawing Sheets

INTEGRATED NOISE REDUCTION CONNECTOR

CROSS-REFERENCES TO RELATED APPLICATIONS

This application is continuation of U.S. patent application Ser. No. 12/889,249, filed Sep. 23, 2010. The entire contents are incorporated herein by reference for all purposes.

BACKGROUND OF THE INVENTION

The present invention relates generally to connectors such as board-to-board level connectors used in computers and other electronic devices. More particularly, embodiments of the invention pertain to connectors having one or more magnetic elements integrated into the connector to reduce signal interference and other noise.

Modern computer and other electronic systems typically include electronic components packaged on one or more printed circuit boards (PCBs). Board-to-board (B2B) connectors are used to connect electronic components formed on one PCB to those formed on another PCB. As such, B2B connectors come in a variety of different shapes and formats depending on the type of connection required for a particular application.

FIGS. 1A-1C are simplified perspective views of three different B2B connectors 10, 20 and 30 designed to affect perpendicular, horizontal and mezzanine type connections, respectively. For convenience, and since from a functional standpoint the primary components of each of connectors 10, 20 and 30 are generally identical, FIGS. 1A-1C use the same reference numbers to refer to similar components among the connectors. In each of FIGS. 1A-1C, a B2B connector is shown that includes a male connector portion 11 and a female connector portion 15 attached to PCBs 12 and 16, respectively. Male connector 11 includes contacts 13 that extend from an insulative housing 14. Female connector 15 includes contacts 17 that, while not shown in FIG. 1A, extend within an insulative housing 18 in which contact locations 19, adapted to mate with contacts 13, are formed. Contacts 13 and 19 are soldered to their respective PCB. When male connector 11 is engaged with female connector 15, electrical connections are made between circuits on PCB 12 and PCB 16.

Ferrite materials have been previously used to combat signal noise in electronic circuits. As one example, ferrite beads, which as their name implies are small devices made of ferrite material having a hole in their center through which an electric signal wire can pass, have been incorporated onto printed circuit boards for noise reduction. Over time, the density of electronic components, electronic traces and other elements has increased on PCBs and the spacing or pitch of contacts 13 and 17 required in the connectors such as connectors 10, 20 and 30 discussed above has become smaller. The decreases in size make it difficult for components such as ferrite beads, the physics of which cannot be shrunk like electronic traces, to be incorporated onto the boards. These factors combine so that it is sometimes not possible to choose the most optimal signal layout to prevent cross-talk between pins so that signal transmission is not adversely effected. Thus, despite the use of ferrite beads and other ferrite elements on PCBs to improve signal characteristics, improved techniques for suppressing noise in electronic circuits are desirable.

BRIEF SUMMARY OF THE INVENTION

The present invention provides a connector that has improved noise reduction capabilities as compared to standard connectors. Embodiments of the invention surround one or more of the connector pins with a ferromagnetic material that filters unwanted high frequency noise from the signal transmitted by the one or more pins. Some embodiments of connectors according to the present invention integrate ferromagnetic elements in the connector by coupling the ferromagnetic elements directly to one or more of the connector pins. Other embodiments incorporate a ferrite material within the connector body itself. While embodiments of the invention are particularly useful for board-to-board connectors, the invention is not so limited and can be applied to any type of connector where noise reduction is beneficial.

In one particular embodiment, an electrical connector is provided that comprises an insulative body, a plurality of pins carried by the body and a ferromagnetic element that rides on one of the plurality of the pins. The ferromagnetic element provides a low pass filter capability for signals transmitted over the one pin. In certain embodiments, ferromagnetic elements are provided on each of the plurality of pins and in some specific embodiments, the ferromagnetic elements are ferrite beads.

In another embodiment, an electrical connector is provided that comprises an insulative body and a plurality of pins carried by the body. A portion of the insulative body that surrounds a cross-sectional portion of one or more of the plurality of pins comprises ferrite particles that provide a low pass filter capability for signals transmitted over the pins. In certain embodiments, the insulative body is formed from a ferrite-thermoplastic material. In other embodiments, the insulative body includes a thermoplastic base portion and ferrite-thermoplastic inserts attached to the base portion that provide the low pass filter capability.

In still another embodiment, an electronic component is provided that comprises a printed circuit board and an electrical connector. The printed circuit board has a plurality of conductive traces formed on its surface. The electrical includes an insulative body that carries a plurality of pins and a ferromagnetic element coupled to one of the pins. The pins are electrically coupled to the conductive traces formed on the printed circuit board; and the ferromagnetic element provides a low pass filter capability for signals transmitted over the pin to which it is coupled.

To better understand the nature and advantages of these and other embodiments of the present invention, reference should be made to the following description and the accompanying figures. It is to be understood, however, that each of the figures is provided for the purpose of illustration only and is not intended as a definition of the limits of the scope of the present invention. It is to be further understood that, while numerous specific details are set forth in the description below in order to provide a thorough understanding of the invention, a person of skill in the art will recognize that the invention may be practiced without some or all of these specific details.

DETAILED DESCRIPTION OF THE INVENTION

Figure 1A:
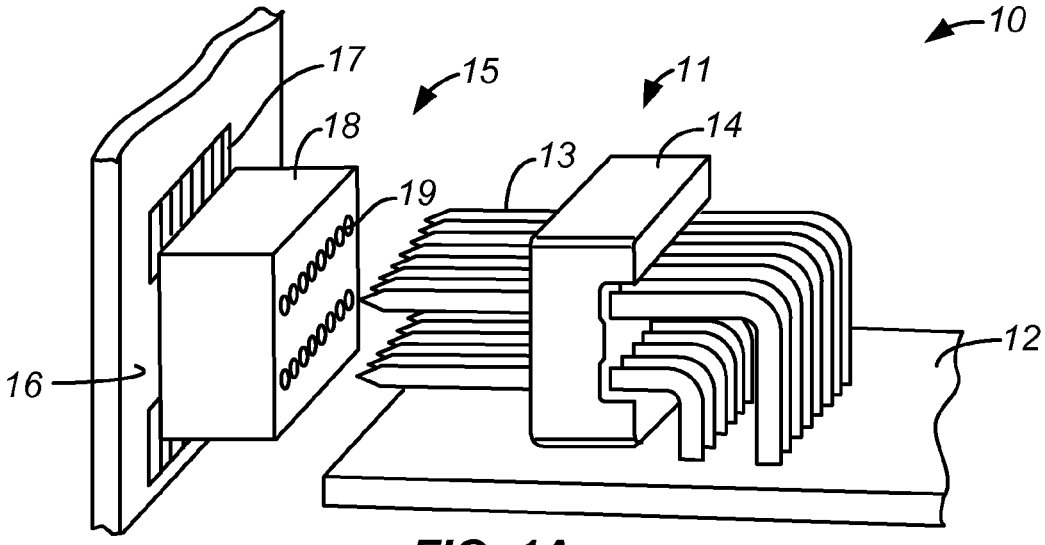
FIG. 1A (PRIOR ART)
FIGS. 1A-1C are simplified perspective views of three different types of board-to-board connectors according to the prior art.
Figure 1B:
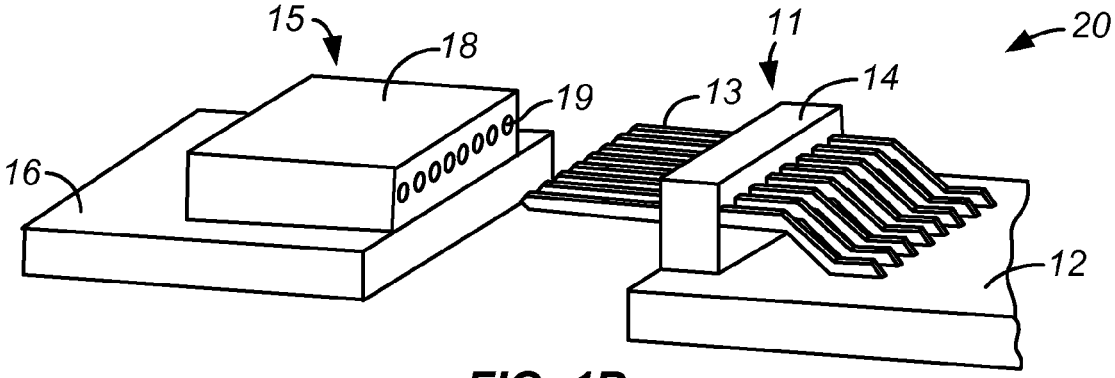
FIG. 1B (PRIOR ART)
Figure 1C:
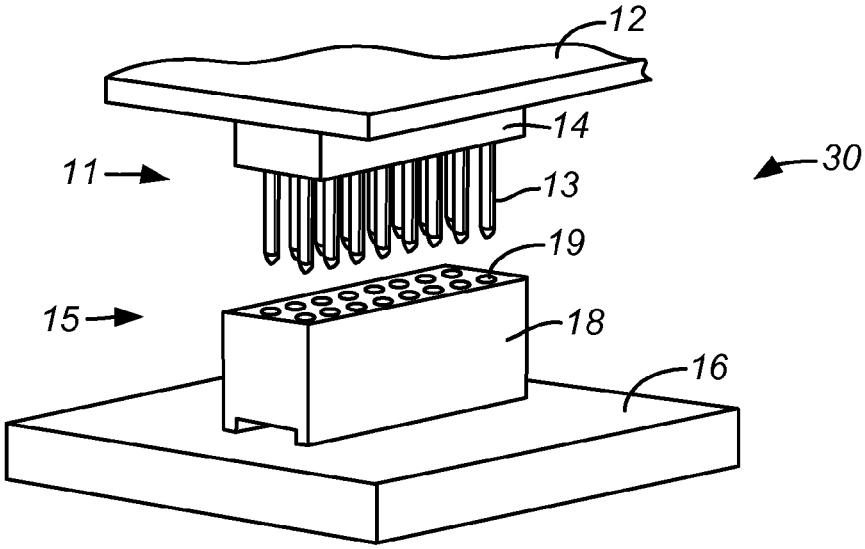
FIG. 1C (PRIOR ART)
Figure 2:
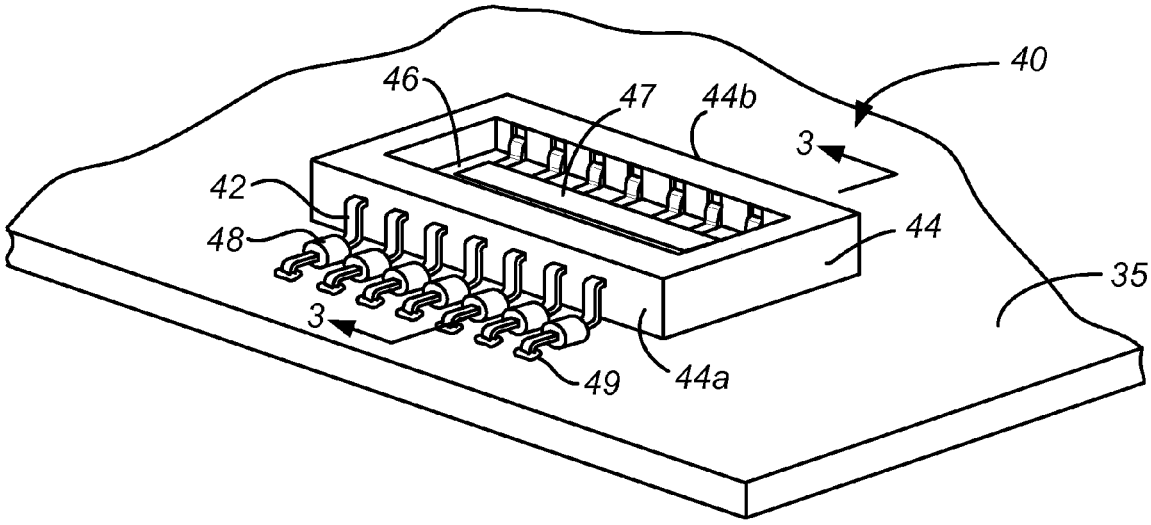
FIG. 2 is a simplified perspective view of a female connector 40 according to an embodiment of the present invention.
Figure 3:
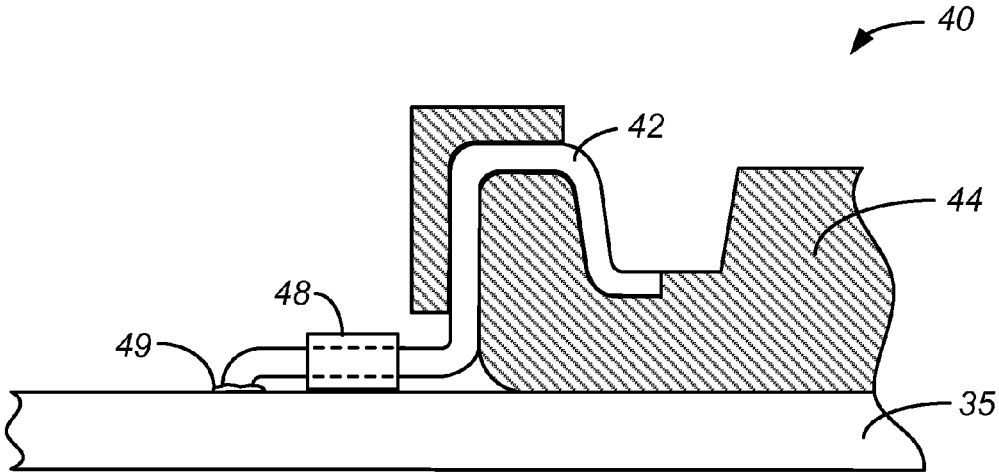
FIG. 3 is a simplified cross-sectional view of connector 40 shown in FIG. 2 along lines 3-3.

In order to better appreciate and understand the present invention, reference is made to FIGS. 2 and 3 where FIG. 2 is a simplified perspective view of a female connector 40 according to one embodiment of the present invention and FIG. 3 is a simplified cross-sectional view of connector 40 taken along lines A'A'. Connector 40 includes a plurality of pins 42 that extend from an insulative housing or body 44. Pins 42 can be electrically coupled to circuitry formed on a printed circuit board 35 by aligning the ends of the pins with circuit traces (not shown) on PCB 35 and soldering the pins thereto with solder 49. Each of the pins 42 is made from a conductive material and may be plated to improve conductivity and resistance to oxidation. In on particular embodiment, pins 42 are made from a copper alloy such as phosphor bronze.

Body 44 is made from an insulative material, such as liquid crystal polymer (LCP) or other similar thermoplastic materials with high mechanical strength, strong resistance to cracking and a low dielectric constant. Body 42 includes an interior cavity 46. Pins 42 extend from each of the major opposing sides 44*a* and 44*b* of the body into a portion of cavity 46 where they are exposed and can be electrically coupled to a pin in a corresponding male connector (now shown) designed to mate with connector 40. Cavity 46 is formed around a raised center section 47 that facilitates proper alignment of a corresponding male connector (not shown) when the connectors are mated together.

Connector 40 also includes a plurality of ferromagnetic elements 48 operatively coupled to pins 42. Each ferromagnetic element 48 is a passive low pass filter component that reduces high frequency noise on its respective pin by attenuating signals above a cut-off frequency of the filter. Ferromagnetic elements 48 can be made from any appropriate ferrite material and, and in one particular embodiment are ferrite beads that can threaded over pins 42 such that a portion of the pin traverses the hole in the bead.

Different ferrite materials have different filter ranges. Thus, the low pass filtering properties of the ferromagnetic element are determined by the ferrite material the element is made from as well as the element's dimension. When a ferromagnetic element 48 is a ferrite bead, the beads dimensions, including its length and its outer diameter as compared to its inner diameter, affect its noise reduction properties. Once the desired cutoff frequency and attenuation level for a given connector is identified (e.g., based on the types of signals the connector is expected to be used for), a person of skill in the art can design a ferromagnetic element 48 or select a commercially available ferrite bead that has matching filtering characteristics.

As shown in FIG. 3, which is a simplified cross-sectional view of connector 40 taken along lines 3-3, each ferromagnetic element 48 is integrated onto an end of its corresponding pin 42 where the pin extends out from housing 44. In this manner the ferromagnetic element rides on its respective pin at a location between where the pin is soldered to PCB 35 (solder connection 49) and a location where the pin extends from housing 44.

The size of the hole through ferromagnetic element 48 can be matched to the diameter of the pin 42 so that the ferromagnetic element fits tightly over the pin and can be secured in place by friction. In other embodiments, ferromagnetic element 48 can be bonded to pin 42 with an appropriate adhesive. In some embodiments ferromagnetic element 48 is a single piece of ferrite material that can be slid over the pin from its end towards the body while in other embodiments element 48 is a clamp-on type device that can be positioned at a desired location over the pin in the open position and then clamped shut to secure itself onto the pin.

Connectors used in applications that require high frequency signals, such as data signals received over an antenna from a WiFi or cellular network connection where the signal frequency is in or near the Gigahertz range, are particularly susceptible to noise problems. Some modern portable computing devices such as smart phones include two or more separate antennas adapted to receive signals at different frequencies. For example, a first antenna may be adapted to receive Bluetooth and 802.11 (e.g., WiFi) signals in the 2.4 GHz and 5 GHz range while a second antenna may be adapted to receive voice signals over a cellular network at 850 MHz or 1900 MHz. In one particular embodiment, a connector is provided that includes different ferromagnetic elements 48 matched to different filter ranges. Thus, a first ferromagnetic element that acts as a low pass filter suited for 2.4 GHz and 5 GHz signals can be operatively coupled to the pin associated with the Bluetooth and 802.11 antenna while a second ferromagnetic element that acts as a low pass filter suited for 850 MHz and 1900 MHz signals can be operatively coupled to the pin associated with the voice signals. In other embodiments, it is possible to have ferromagnetic elements 48 with different filtering characteristics associated with each pin on the connector.

Figure 4:
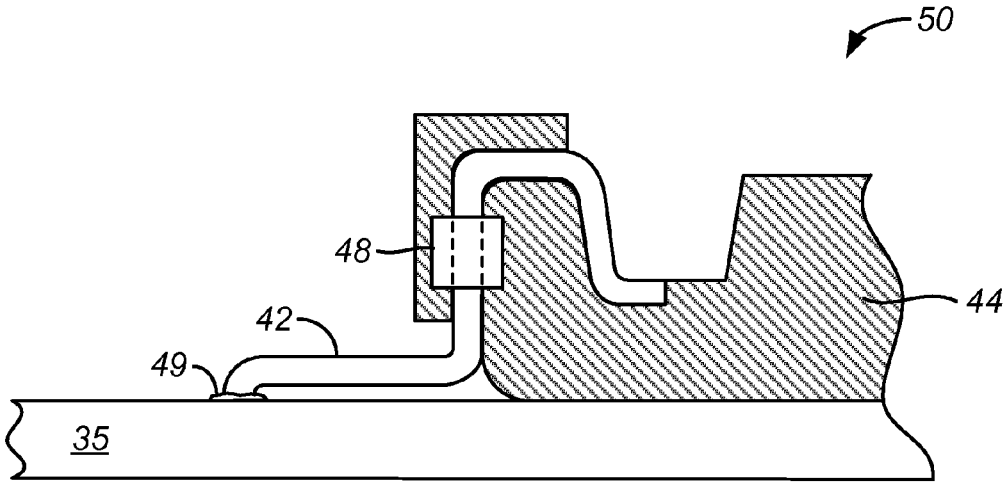
FIG. 4 is a simplified perspective view of a female connector 50 according to another embodiment of the present invention.

FIG. 4 is a simplified cross-sectional view of a connector 50 according to another embodiment of the invention. Connector 50 includes ferromagnetic elements 48 that ride their respective pins 42 at a location within body 44 and thus are generally not visible on connector 50 unless the connector is taken apart. The embodiment of FIG. 4 has the benefit of securing ferromagnetic elements 48 completely within the body so that that ferromagnetic elements cannot be accidentally separated from the connector unless the connector itself is taken apart.

Body 44 in connector 50 can be formed in an injection molding or similar process. Prior to the formation of body 44, ferromagnetic elements 48 can be threaded, clamped or otherwise positioned over pins 42 in connector 50. The pins with attached ferromagnetic elements can then be placed in an appropriate mold so that body 44 is formed around the pins and around the ferromagnetic elements coupled to the pins.

Figure 5:
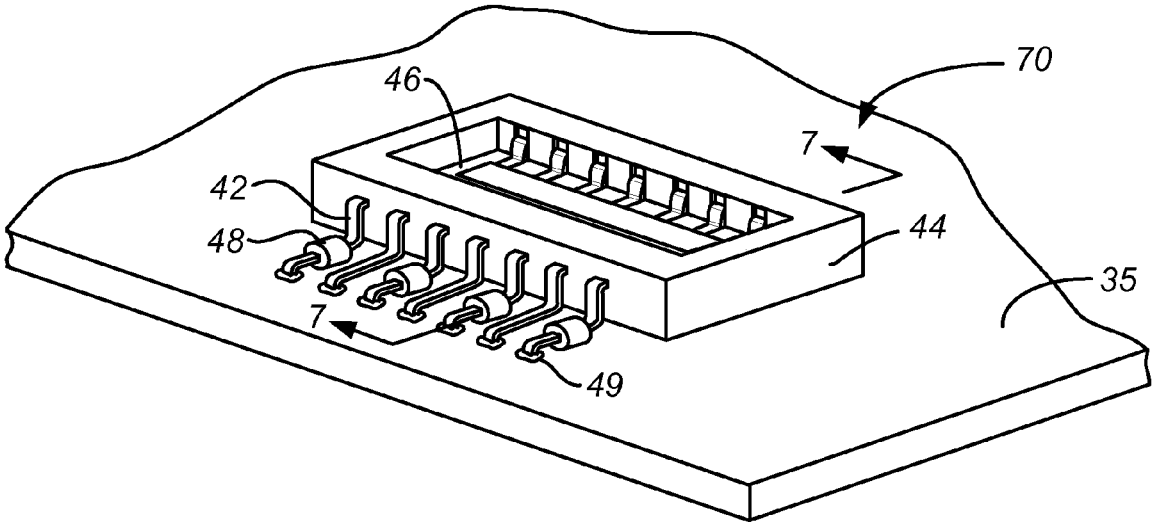
FIG. 5 is a simplified perspective view of a female connector 60 according to yet another embodiment of the present invention.

In the embodiments discussed above with respect to FIGS. 2-4, a ferromagnetic element 48 is coupled to each of the pins 42 in connector 40. Other embodiments may include ferromagnetic elements coupled to only a subset of the pins 42, such as only pins that carry signals which are the most susceptible to high frequency noise. Such embodiments may be particularly useful where the pitch of the connector leaves little space for ferromagnetic elements. As an example, reference is now made to FIG. 5, which is a simplified perspective view of a female connector 60 according to another one embodiment of the present invention. As shown, connector 60 includes fourteen pins, seven that extend from a first major side 44*a* and seven pins that extend from a second major side 44*b*. Ferromagnetic elements 48 are positioned on every other pin such that pins without ferromagnetic elements are interleaved with pins having ferromagnetic elements coupled to them. This arrangement allows the pins to be placed closer together than they may otherwise be positioned in the embodiments discussed with respect to FIGS. 2-4 and/or allows each ferromagnetic element 48 to be larger than it otherwise may be allowing additional design choices and frequency characteristics for each ferromagnetic element 48.

Figure 6:
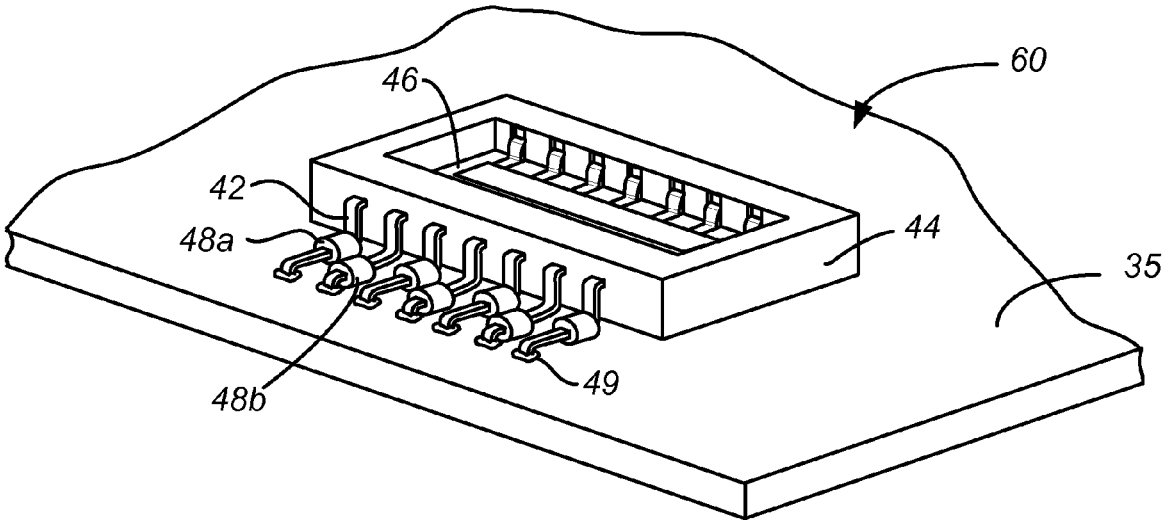
FIG. 6 is a simplified perspective view of a female connector 70 according to still another embodiment of the present invention.

In other embodiments where smaller connector pitches are required or otherwise used, ferromagnetic elements 48 can be staggered in order to enable pins 42 to be positioned closer together and/or to enable larger diameter ferromagnetic elements than is otherwise possible. FIG. 6, which is a simplified perspective view of a female connector 70 according to another embodiment of the present invention, is illustrative of such embodiments. As shown in FIG. 6, adjacent ferromagnetic elements 48*a* and 48*b* are arranged in a staggered relationship so that the placement of element 48*a* does not interfere with the placement of element 48*b*, and vice-versa, allowing the pitch of pins 42 to be tighter than otherwise possible. Other types of staggering relationships are possible.

Figure 7:
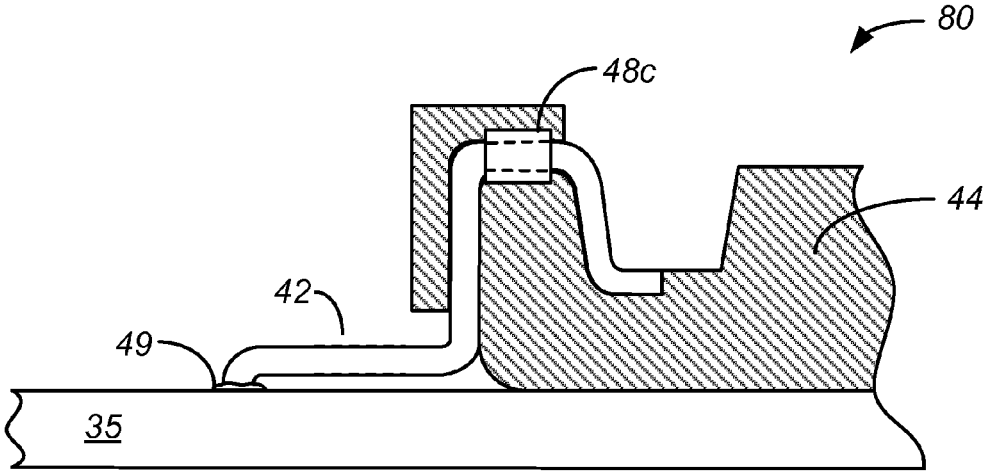
FIG. 7 is are a simplified cross-sectional view of a female connector 80 according to another embodiment of the invention taken along the same lines 3-3 shown in FIG. 2.

As another illustration of a staggered arrangement, FIG. 7 shows a simplified cross-sectional view of a female connector 80 according to another embodiment of the invention. While not shown in FIG. 7, from a perspective view connector 80 is similar to connector 60 shown in FIG. 6 except that connector 80 does not include ferromagnetic elements 48*a* and 48*b* coupled to its pins 42 at a position outside housing 44. Instead, the ferromagnetic elements are included in connector 80 within housing 44. Along a first set of pins, ferromagnetic elements 48 are positioned within connector 80 coupled to a vertical section of the connector pins as shown in FIG. 4. Along a second set of pins, interleaved with the first set of pins, connector 80 includes ferromagnetic elements 48*c* that are positioned along a flat portion of pin 42 near a top of the connector as shown in FIG. 7. Positioning the ferromagnetic elements on different, non-overlapping portions of the pins within connector body 44 results in the ferromagnetic elements 48 and 48*c* having a staggered relationship within the body.

Figure 8:
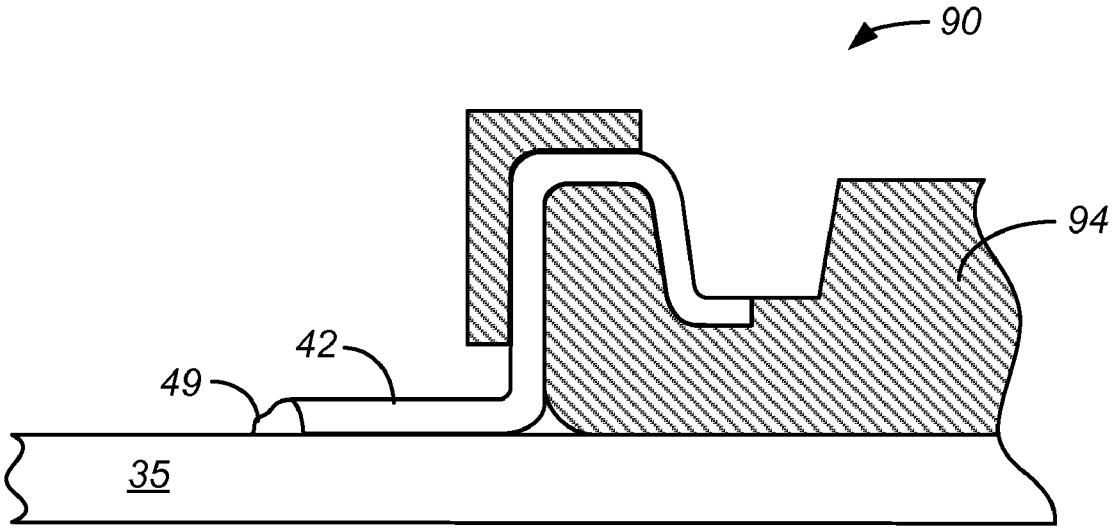
FIG. 8 is a simplified cross-sectional view of a female connector 90 according to another embodiment of the invention.

FIG. 8 is a simplified cross-sectional view of a connector 90 according to yet another embodiment of the invention. Connector 90 incorporates a ferrite material directly in the insulative body 94 of the connector and thus each of pins 42 is surrounded by ferrite body 94 over the length of the pin embedded within the body. Ferrite particles or powder can incorporated into body 94 by first mixing the particles/powder with a thermoplastic resin such as LCP. Preferably the ferrite-thermoplastic mixture is sufficiently mixed so that the ferrite material is evenly distributed throughout the mixture. Once the ferrite-thermoplastic mixture is formed, it can be injected into a mold shaped in the form of body 94 using an injection molding or similar process. The signal filtering properties of ferrite body 94 will depend on the volume of ferrite particles in the body and the composition of the ferrite particles as well as the size and shape of body 94 itself. Each of these factors can be varied as needed so that body 94 can be designed to suppress unwanted high frequency noise from pins 42.

In some embodiments, magnetized insulative bodies are used for both the male and female connectors to form a magnetic connector system in which the male and female connectors magnetically attract each other to form a secure connection. In order to break the connection, the magnetic force of the connector system must first be overcome. A pair of male and female magnetized connectors according to embodiments of the invention may be formed, for example, by the ferrite-thermoplastic injection molding process described above. The male and female connectors can then be magnetized to have opposite polarities so that they attract each other when they are placed in sufficient proximity with each other.

Figure 9:
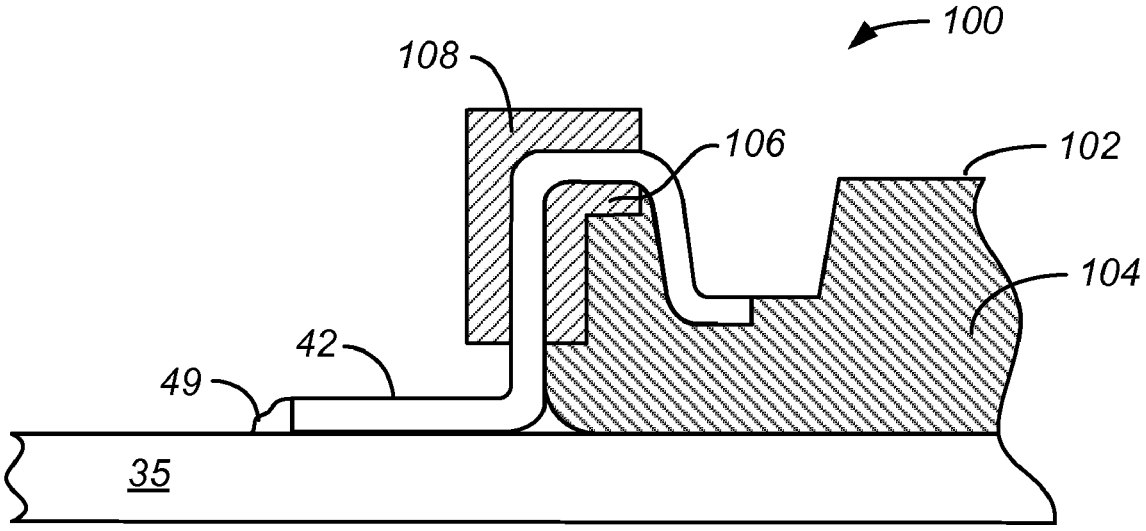
FIG. 9 is a simplified cross-sectional view of a male connector 100 according to an embodiment of the present invention.

FIG. 9 is a simplified cross-sectional view of a connector 100 according to another embodiment of the invention. Connector 100 includes a insulative body 102 that includes a thermoplastic base portion 104 and ferrite-thermoplastic inserts 106, 108. Base portion 104 can be similar in composition to body 44 discussed above with respect to connector 40 and thus can be made from a thermoplastic material such as LCP. Ferrite inserts 106 and 108 can each be made from a ferrite-thermoplastic mixture as described above with respect to body 94. Each of base portion 104 and inserts 106, 108 can be formed in an injection molding process or other suitable process. Insert 106 is shaped so it can be secured to base portion 104 by, for example, a snap-on fit or with an adhesive. Insert 108 can then similarly be secured to insert 106. Inserts 106, 108 combine to form an upper portion of body 102 through which pins 42 are inserted. The pins may be integrated into body 102 after insert 106 is attached to base portion 104 but before insert 108 is attached or may be inserted through body 102 after each of the separate pieces 104, 106 108 are assembled together. Alternatively, inserts 106, 108 can be fabricated as a single insert that is formed by an injection molding process around pins 42 and then the subassembly of pins 42, insert 106, 108 can be secured to base portion 104 with an adhesive or snap-on fit to complete the assembly of connector 100.

In some embodiments, where high frequency filtering is desirable for a subset of pins 42, base portion 104 is formed to accept inserts 106, 108 only at pin locations where such filtering is desirable. Thus, in locations where inserts are not needed, body 102 is made up entirely of base portion 104 which is shaped so that the pins extend through the base portion in that portion of the connector rather than through the inserts. In locations where inserts 106, 108 are used, the cross-section of the connector would include inserts 106, 108 as shown on connector 100 in FIG. 9. It should be noted, however, that while inserts 106, 108 are shown in FIG. 9 as generally having an L-shaped cross-section, the invention is not limited to any particular shape for the ferrite-thermoplastic inserts. Inserts having a variety of other shapes are possible.

As will be understood by those skilled in the art, the present invention may be embodied in other specific forms without departing from the essential characteristics thereof. For example, while embodiments of the invention were discussed above with respect to B2B connectors, the inventions described herein can be used in conjunction with any connector where reduction of noise that may otherwise travel on the connector pins is desirable. As another example, while most of the illustrate examples of the invention discussed above were presented with respect to female connectors suitable for a mezzanine type connection, the invention is equally applicable to male connectors and connectors used parallel, horizontal and other arrangements. Additionally, embodiments of the invention can be used in both the female and mating male connectors in a connector system. Those skilled in the art will recognize, or be able to ascertain using no more than routine experimentation, many equivalents to the specific embodiments of the invention described herein. Such equivalents are intended to be encompassed by the following claims.

What is claimed is:

1. An electrical connector, comprising:

an insulative body having a plurality of through holes formed therein; and a plurality of pins carried by the body, each of the plurality of pins having a first end, a second end and a connecting portion between the first and second ends that extends through one of the plurality of through holes in the insulative body so that the connecting portion is surrounded by the insulative body;

wherein at least a portion of the insulative body surrounding the connecting portion of one or more pins in the plurality of pins comprises ferrite particles providing a low pass filter capability for signals transmitted over the pins.

2. The electrical connector of claim 1 wherein the insulative body is formed from a ferrite-thermoplastic material.

3. The electrical connector of claim 1 wherein the insulative body is formed with an injection molding process.

4. The electrical connector of claim 1 wherein the insulative body is magnetized.

5. The electrical connector of claim 1 wherein the insulative body includes a base portion and a ferrite-thermoplastic insert coupled to the base portion that provides the low pass filter capability, and wherein at least a subset of the plurality of pins extend through the ferrite-thermoplastic insert.

6. The electrical connector of claim 1 wherein the connector is a board-to-board connector.

7. The electrical connector of claim 1 wherein the connector is a female connector.

8. The electrical connector of claim 1 wherein the connector is a male connector.

9. The electrical connector of claim 1 wherein the entirety of the insulative body is formed from a ferrite-thermoplastic material.

10. The electrical connector of claim 9 wherein each of the plurality of pins carried by the body is surrounded by ferromagnetic material over a length of the pin embedded within the body.

11. The electrical connector of claim 1 wherein the insulative body comprises a non-ferrite thermoplastic material base portion and a ferrite insert secured to the base portion, wherein one or more pins in the plurality of pins extends through the ferrite insert.

12. The electrical connector of claim 11 wherein the ferrite insert comprises first and second portions joined together.

13. The electrical connector of claim 11 wherein the first and second portions of the ferrite insert are joined together in a snap-on fit.

14. The electrical connector of claim 11 wherein the first and second portions of the ferrite insert are joined together by an adhesive.

15. The electrical connector of claim 11 wherein each of the plurality of pins that extends through the ferrite insert at an intersection of the first and second portions.

16. The electrical connector of claim 11 wherein the ferrite insert is formed in an injection molding process around one or more pins in the plurality of pins.

17. An electrical connector, comprising:

an insulative body; and a plurality of pins carried by the body;

wherein at least a portion of the insulative body surrounding a cross-sectional portion of one or more pins in the plurality of pins comprises ferrite particles providing a low pass filter capability for signals transmitted over the pins;

wherein the insulative body comprises a non-ferrite thermoplastic material base portion and a ferrite insert secured to the base portion, and wherein a first subset of pins in the plurality of pins extend through the ferrite insert and a second subset of pins extend only through the non-ferrite thermoplastic material base portion of the insulative body.

18. The electrical connector of claim 17 wherein the ferrite insert comprises first and second portions joined together.

19. The electrical connector of claim 17 wherein the first and second portions of the ferrite insert are joined together in a snap-on fit.

20. The electrical connector of claim 17 wherein the first and second portions of the ferrite insert are joined together by an adhesive.

21. The electrical connector of claim 17 wherein each of the plurality of pins that extends through the ferrite insert do so at an intersection of the first and second portions.

* * * * *